US010449576B1

(12) United States Patent
Rotanelli

(10) Patent No.: US 10,449,576 B1
(45) Date of Patent: Oct. 22, 2019

(54) WEIGHTED DOCK MAINTENANCE TOOL

(71) Applicant: Ronald C. Rotanelli, Fort Lauderdale, FL (US)

(72) Inventor: Ronald C. Rotanelli, Fort Lauderdale, FL (US)

( * ) Notice: Subject to any disclaimer, the term of this patent is extended or adjusted under 35 U.S.C. 154(b) by 288 days.

(21) Appl. No.: 15/454,016

(22) Filed: Mar. 9, 2017

(51) Int. Cl.

| | |
|---|---|
| ***B25G 1/04*** | (2006.01) |
| ***B08B 1/00*** | (2006.01) |
| ***B63B 59/06*** | (2006.01) |
| ***E04F 21/06*** | (2006.01) |

(52) U.S. Cl.
CPC ..... *B08B 1/005* (2013.01); *B25G 1/04* (2013.01); *B63B 59/06* (2013.01); *E04F 21/06* (2013.01)

(58) Field of Classification Search
CPC . E04F 21/06; E04F 21/16; B25G 1/10; B08B 1/005
See application file for complete search history.

(56) References Cited

U.S. PATENT DOCUMENTS

| | | | | |
|---|---|---|---|---|
| 1,473,546 A | | 11/1923 | Eiermann | |
| 1,774,207 A | * | 8/1930 | Meissner | A47J 45/08 16/431 |
| 2,286,190 A | | 6/1942 | Abrahamsen | |
| 3,036,482 A | * | 5/1962 | Kenworthy | B25C 1/02 173/90 |
| 4,901,801 A | * | 2/1990 | Popivalo | A01B 1/20 172/375 |
| 5,010,647 A | | 4/1991 | Gray | |
| 5,353,465 A | | 10/1994 | Pierce et al. | |
| 5,433,005 A | | 7/1995 | Cogdill et al. | |
| 5,479,675 A | * | 1/1996 | Pytlewski | B25G 3/08 15/145 |
| 5,522,111 A | * | 6/1996 | Kelsay | B25G 1/10 15/143.1 |
| 5,778,482 A | * | 7/1998 | Sbrigato | E04F 21/241 15/235.4 |
| 5,996,231 A | | 12/1999 | Roche et al. | |
| 8,475,072 B1 | | 7/2013 | Buckner et al. | |
| 8,528,153 B1 | * | 9/2013 | Hogan | E04F 21/04 15/235.4 |
| D721,213 S | | 1/2015 | Hamilton | |
| 8,973,206 B1 | * | 3/2015 | Vivonetto | E04F 21/161 15/235.4 |
| D730,005 S | | 5/2015 | Lin | |

(Continued)

*Primary Examiner* — Michael D Jennings
(74) *Attorney, Agent, or Firm* — Mark D. Bowen; Malin Haley DiMaggio & Bowen, P.A.

(57) ABSTRACT

A scraping tool having a thick, durable scraping blade attached to a weighted main body is particularly useful in scraping encrusted marine growth from seawalls, dock and pier pilings, and bridge structures is disclosed. A scraping blade formed of 316 Stainless Steel having a thickness of approximately 3/16", with a front end that is preferably angled approximately 15-degrees from the longitudinal axis of the tool arranges the blade for maximum effectiveness. The blade has teeth with each tooth defining a beveled upper tip surface to aid in piercing encrusted barnacle growth. The blade is attached to a weighted main body which further includes an axially projecting adaptor for connection to an extension pole. The weighted main body is partially filled with lead shot for enhancing impact forces.

8 Claims, 4 Drawing Sheets

(56) References Cited

U.S. PATENT DOCUMENTS

| | | | | |
|---|---|---|---|---|
| 2008/0060159 | A1* | 3/2008 | Martin | B25G 1/06 15/235.4 |
| 2010/0162504 | A1 | 7/2010 | Shaffer | |
| 2013/0233347 | A1* | 9/2013 | Wang | A47L 17/08 134/6 |

* cited by examiner

WEIGHTED DOCK MAINTENANCE TOOL

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention relates generally to hand tools, and more particularly to a hand tool specifically developed for use in dock maintenance such as for scraping barnacles and the like from surfaces exposed to marine environments.

2. Description of Related Art

Barnacles are encrusting arthropods which attach permanently to a hard substrate. Barnacles adhere to various substrates exposed to marine environments including dock and pier pilings, seawalls, and boat hulls. Barnacle adhere with great strength to surfaces making removal and cleaning extremely difficult and time consuming.

Marine structures, such as docks, pilings, piers, and sea walls rapidly accumulate encrusted layers of barnacles and marine growth. The primary methods employed to remove barnacles and marine growth from surfaces include scraping and pressure cleaning. A number of scraping tools are known in the art. For example, published U.S. Patent Application No. US 2010/0162504, to Shaffer, discloses a boat cleaning tool having a plurality of cleaning surfaces, each of which is designed to be used on a specific part of a boat. In addition, conventional paint scraping tools are often employed. Attempts to remove barnacles and marine growth using conventional scraping tools, however, has met with limited success. Conventional tools are typically lightweight devices having relatively thin, straight blades, and have proven ineffective in removing encrusted barnacle growth. Accordingly, there exists a need for advancements in the field of scraping tools suitable for use in removing encrusted marine growth from docks and other structures in marine applications.

BRIEF SUMMARY OF THE INVENTION

The present invention overcomes the limitations in the art by providing an improved dock maintenance scraping tool having a thick durable scraping blade attached to a weighted main body which is further adapted with an extension pole adapter which allows the scraping tool to be removably attached to an extension pole. A first significant aspect of the present invention involves providing the scraping device having a scraping blade formed of 316 Stainless Steel having a thickness of approximately 3/16", with a front end that is preferably angled approximately 15-degrees from the longitudinal axis of the tool so as to arrange the blade for maximum effectiveness. The blade terminates at its distal end with a plurality of acute-angled teeth, with each tooth defining beveled upper tip surfaces that aid in piercing encrusted barnacle growth to facilitate prying barnacles from the surfaces to which they are adhered. In a preferred embodiment the blade is removable and interchangeable with alternate blades having different terminal end teeth configurations. The blade is attached to a main body which includes a distal end forming a blade mount, an intermediate portion defining an internal chamber partially filled with metal weight members, and a proximal end having an axially projecting adapter for connection to an extension pole. The use of weight members adds significant weight to the scraping tool thereby increasing the dead blow impact delivered to encrusted marine growth.

Accordingly, it is an object of the present invention to provide an improved scraping tool specifically designed for use in maintain docks and other structures in marine environments.

It is another aspect of the present invention to provide an improved scraping tool specifically designed to remove encrusted marine growth from surfaces exposed to marine environments.

Another object of the present invention is to provide a weighted scraping tool to maximize dead blow impact when in use.

Still another object of the present invention is to provide a scraping tool having a substantial angled scraping blade terminating in beveled teeth specifically configured to pierce encrusted barnacle growth.

In accordance with these and other objects, which will become apparent hereinafter, the instant invention will now be described with particular reference to the accompanying drawings.

DETAILED DESCRIPTION OF THE INVENTION

Figure 1:
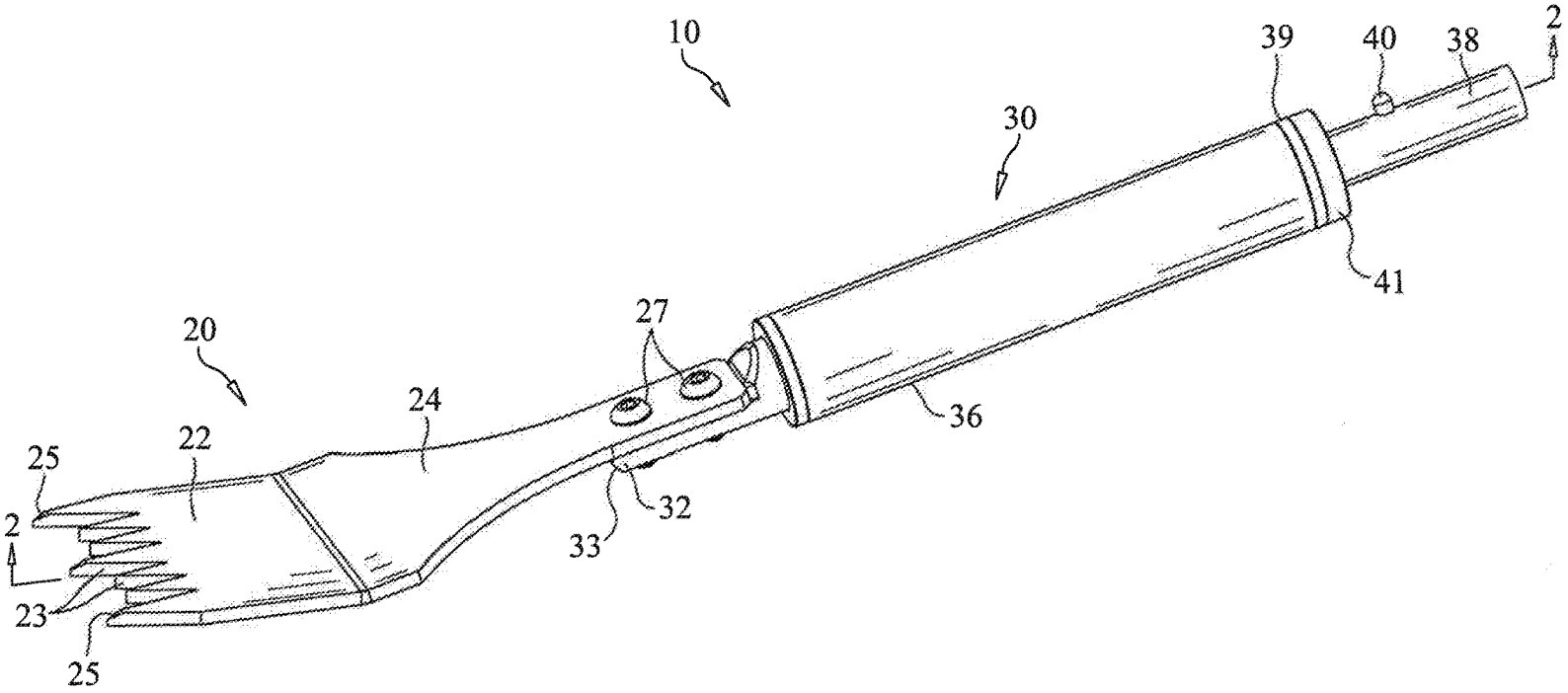
FIG. 1 is a perspective view of a scraping tool in accordance with the present invention.

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Turning now to the drawings, FIGS. 1-4 depict barnacle scraping tool, generally referenced as 10, in accordance with the present invention. Scraping tool 10 includes a scraping blade, generally referenced as 20, and a main body, generally referenced as 30. Scarping blade 20 includes a distal end 22 and a tang 24 extending from the distal end. Scraping blade 20 is preferably formed of 316 Stainless Steel having a thickness of approximately 3/16" so as to provide a sufficiently strong scraping structure. Distal end 22 terminates in a plurality of projecting tines or teeth 23. Teeth 23 preferably include a beveled top tip surface 25 which aid in piercing encrusted barnacle growth and to facilitate prying barnacles from the surfaces to which they are adhered. In a preferred embodiment, tang 24 extends from distal end 22 to form an angle of approximately 15-degrees from a longitudinal axis of distal end 22 as illustrated by reference "a" in FIG. 2. The angular configuration of blade 20 arranges the blade for maximum effectiveness while allowing the user to pry encrusted barnacles from surfaces. Blade 20, and particularly tang 24 defines a pair of apertures 26 for receiving threaded fasteners 27 to secure blade 20 to main body 30 as more fully discussed below, while allowing the use of interchangeable blades having different terminal end teeth configurations.

Figure 2:
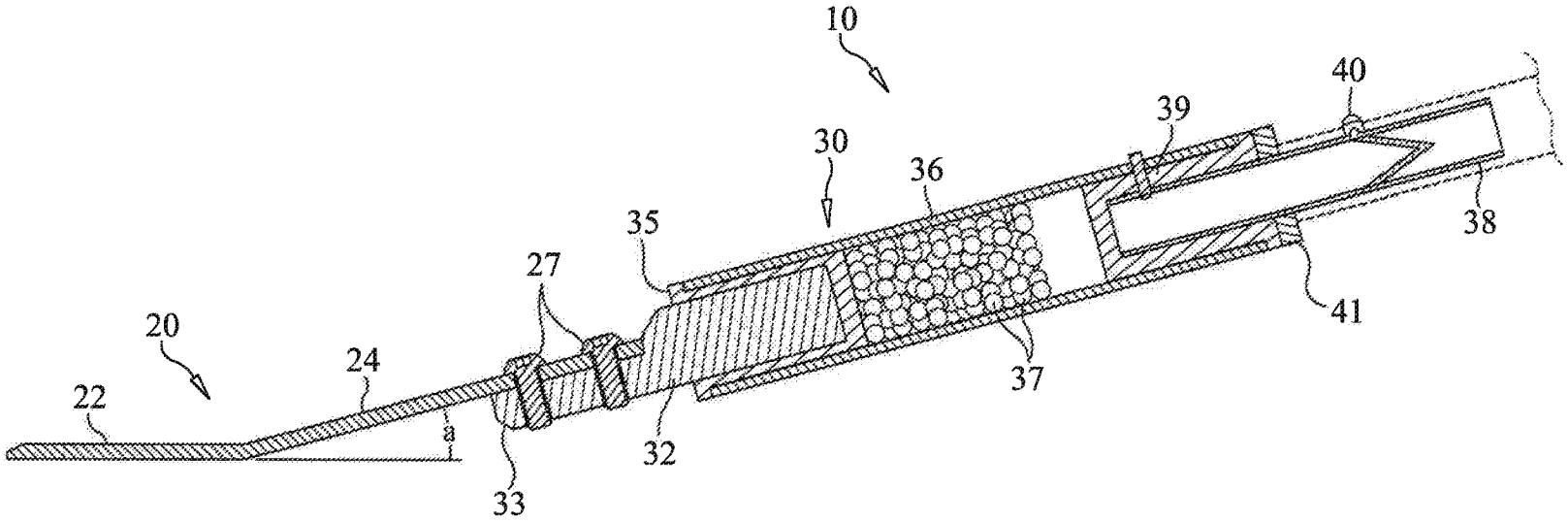
FIG. 2 is a sectional view thereof taken along line 2-2 in FIG. 1.
Figure 3:
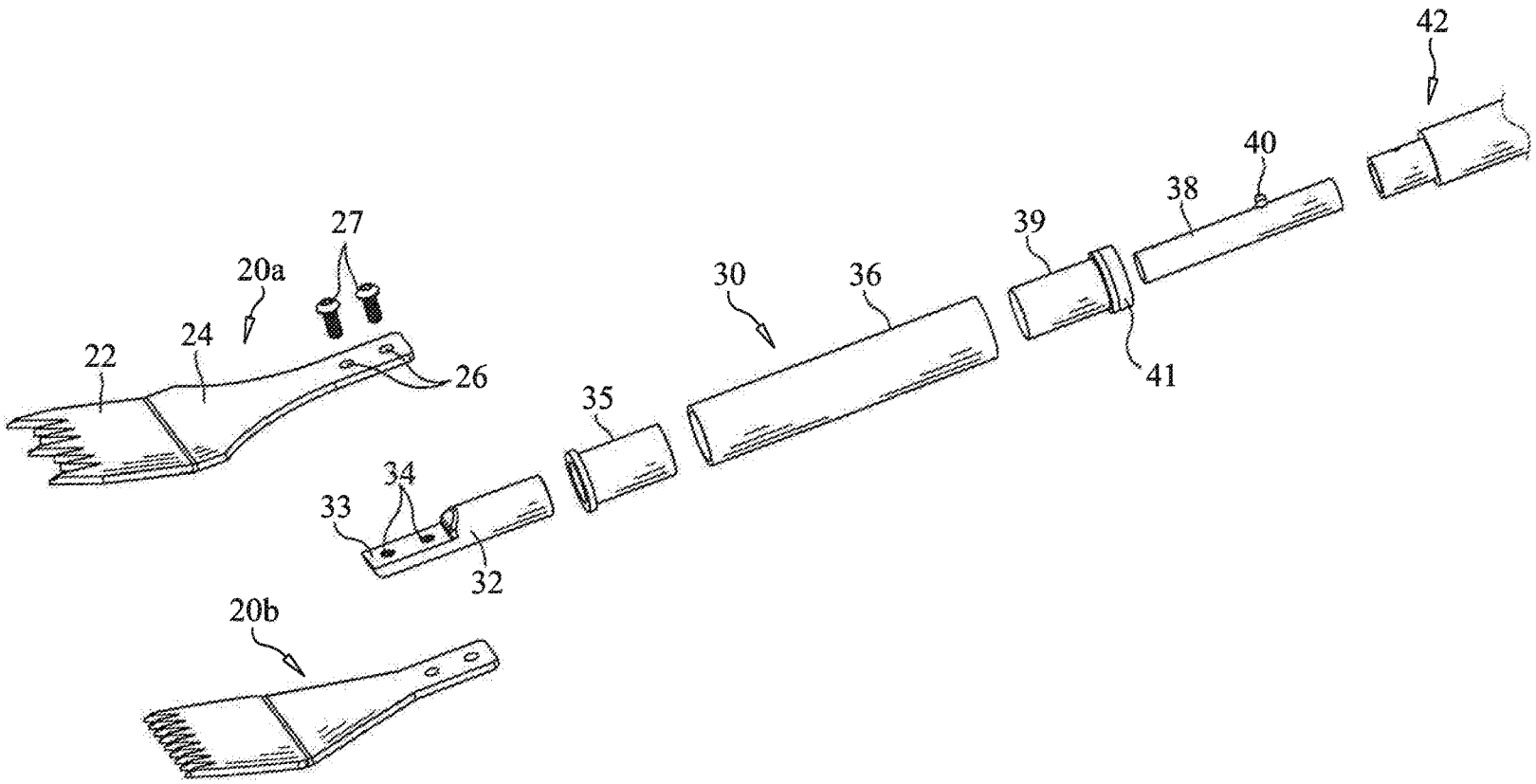
FIG. 3 is an exploded perspective view thereof depicting interchangeable scarping blades and an optional pole extension.
Figure 4:
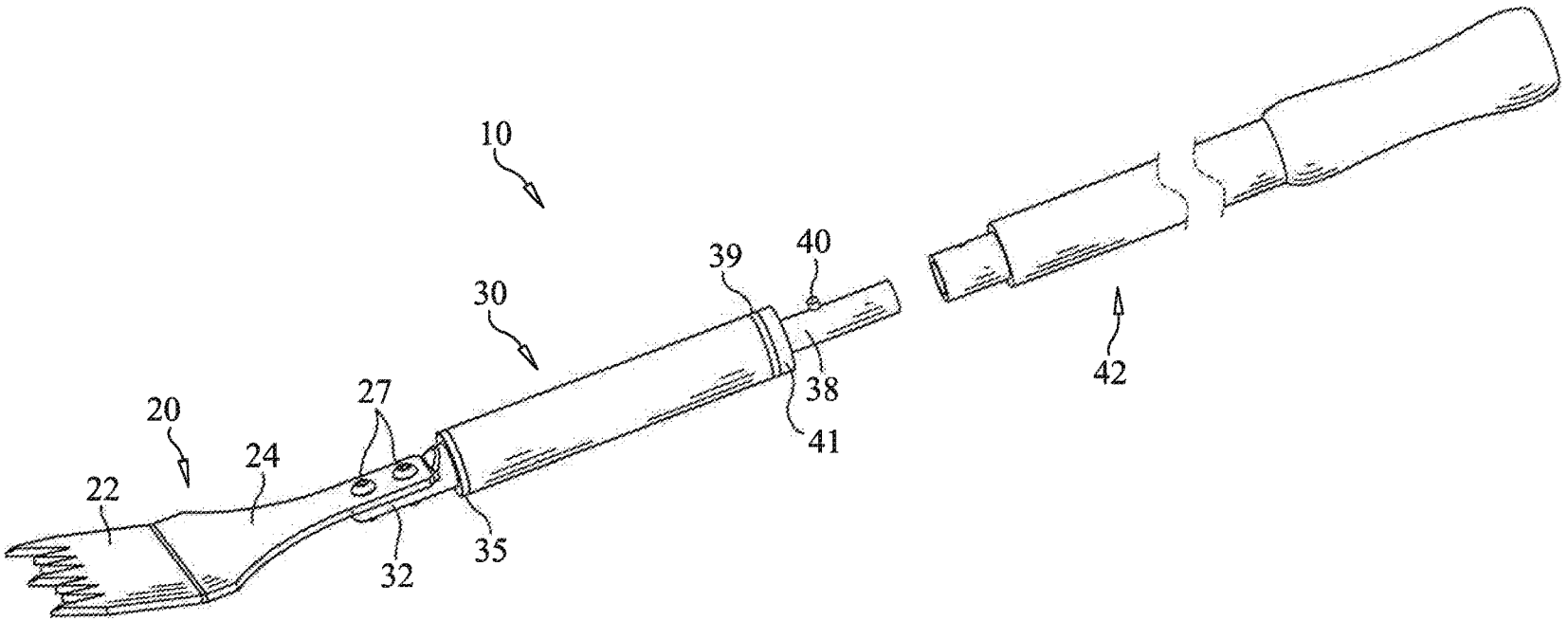
FIG. 4 is a perspective view thereof with an extension pole illustrated in an exploded configuration.

Main body 30 includes a projecting mount 32 having a distal end defining a recessed planar surface terminating at a beveled edge 33. Beveled edge 33 improves piercing performance by eliminating a blunt surface. Mount 32 further defines a pair of threaded apertures 34 defined therein. Blade 20 is removably attached to mount 32 by fasteners 27 as seen in FIGS. 1-3. FIG. 3 shows a plurality of interchangeable blades, referenced as 20*a* and 20*b*, having differing teeth configurations. Mount 32 is secured within the main body assembly by a ferrule 35, which in turn is received within a tubular main body component 36 as illustrated in FIGS. 2 and 3. Main body component 36 comprises a generally tubular body forming a handle and defining an internal volume which is partially filled with metallic weights 37 as best seen in FIG. 2. In a preferred embodiment, weights comprise lead shot, however any suitable material is considered within the scope of the present invention. The presence of weights 37 adds significant weight to the scraping tool thereby increasing the dead blow impact delivered to encrusted marine growth. Importantly, body component 36 is only partially filled with weights 37. Partially filling the body with weights is significant as it generates additional impact as the tool is thrust into encrusted marine growth and the lead shot internally impacts the distal end within handle component 36. More particularly, when in use a typical thrusting action involves a raising action, whereby the weight members shift to the proximal end within main body 36, and a thrusting action terminating in engagement of blade 20 with targeted marine growth which results in rapid deceleration of the tool whereby the weight members rapidly impact within the distal end thereby imparting additional impulse force resulting from the conservation of momentum.

A cylindrical extension pole connector/adapter 38 projects axially from the proximal end of main body assembly 30, and is secured within a resilient ferrule 39. Pole connector 38 includes a button 40 biased to a projecting position as illustrated in FIG. 2. Pole connector 38 is sized and configured for attachment to an optional accessory extension pole 42. Extension pole 42 preferably comprises a fixed or telescopically extendable pole configured for attachment to connector 38. A suitable extension pole is available from Shurhold Industries, Palm City, Fla. A bushing 41 is disposed adjacent to and ferrule 39 and on the proximal side thereof. Bushing 41 functions to absorb impact forces from extension pole 42 when in use so as to avoid exposing button 40 to stress during use. Bushing 41 is preferably either fabricated from or adapted with a resilient shock absorbing material so as to absorb impact shock transmitted to the user by scraping tool 10 by pole 42.

The present invention is useful in removing encrusted barnacles and marine life from submerged or often submerged surfaces such as seawalls, dock and pier pilings, boat hulls, and a vast array of surfaces subject to the accumulation of marine growth. By combining a stout scraping blade with teeth configured for piercing with a weighted main body, the present invention provides a tool that has proven superior to other scraping implements in removing marine growth. A user typically will thrust the tool into marine growth, typically using a downward thrust to realize the advantage of gravity. The advantage of a weighted tool is realized in maximizing dead blow impact on the marine growth. Once pierced into the marine growth, the use may exert a prying motion to pry the growth from the surface.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A scraping tool for use in scraping marine growth from surfaces, said scraping tool comprising:

a main body assembly including a tubular member having a proximal end and a distal end;

said tubular member defining an internal volume;

said internal volume partially filled with weight members;

a blade-mount projecting from said distal end;

a blade having a first end and a second end, wherein said first end defines a tang and said second end defines teeth;

said tang removably connected to said blade mount; and said second end of said blade being angularly offset by approximately 15-degrees relative to said first end of said blade.

2. The scraping tool according to claim 1, wherein each of said teeth has a tip defining a beveled top surface.

3. The scraping tool according to claim 1, further including an extension pole connector projecting from the proximal end of said main body.

4. The scraping tool according to claim 1, wherein said weight members comprise lead shot.

5. The scraping tool according to claim 1, wherein said blade is selected from a group of blades having differing teeth configurations.

6. A scraping tool for use in scraping marine growth from surfaces, said scraping tool comprising:

a main body assembly including a tubular member having a proximal end and a distal end;

said tubular member defining an internal volume;

said internal volume partially filled with weight members;

a blade-mount projecting from said distal end;

said blade having a first end and a second end, wherein said first end defines a tang and said second end defines teeth;

said tang removably connected to an upper surface of said blade mount;

said first and second ends of said blade being angularly offset by approximately 15-degrees;

the distal end of said main body including an axially projecting connector configured to receive an extension pole secured thereto.

7. The scraping tool according to claim 6, wherein each of said teeth has a tip defining a beveled top surface.

8. The scraping tool according to claim 6, wherein said blade mount has a terminal distal end defining a beveled lower edge.

* * * * *